US007510511B2

(12) United States Patent
von Detten

(10) Patent No.: US 7,510,511 B2
(45) Date of Patent: Mar. 31, 2009

(54) EXERCISE TREADMILL HAVING A SIMULATED COBBLESTONE RUNNING SURFACE

(76) Inventor: Volker von Detten, 535 E. Walnut Ave., El Segundo, CA (US) 90245

( * ) Notice: Subject to any disclaimer, the term of this patent is extended or adjusted under 35 U.S.C. 154(b) by 182 days.

(21) Appl. No.: 11/484,549

(22) Filed: Jul. 11, 2006

(65) Prior Publication Data

US 2008/0009396 A1 Jan. 10, 2008

Related U.S. Application Data

(60) Provisional application No. 60/698,502, filed on Jul. 11, 2005.

(51) Int. Cl.
*A63B 22/02* (2006.01)

(52) U.S. Cl. ..... 482/54

(58) Field of Classification Search ..... 482/54; 198/388, 459.5

See application file for complete search history.

(56) References Cited

U.S. PATENT DOCUMENTS 2,154,831 A * 4/1939 Booharin ..... 601/143
4,334,676 A 6/1982 Schonenberger
4,635,927 A 1/1987 Shu
4,635,928 A 1/1987 Ogden et al.
4,659,074 A 4/1987 Taitel et al.
4,892,090 A * 1/1990 Kaeser ..... 601/99
4,925,183 A * 5/1990 Kim ..... 482/61
5,096,188 A * 3/1992 Shen ..... 482/51
5,186,703 A * 2/1993 Huang ..... 482/148
5,279,528 A 1/1994 Dalebout
5,352,166 A * 10/1994 Chang ..... 482/52
5,490,821 A * 2/1996 Wu ..... 601/134
5,527,241 A * 6/1996 Peng ..... 482/54
6,709,365 B2 * 3/2004 Zeilinger ..... 482/35
6,918,859 B1 * 7/2005 Yeh ..... 482/54

* cited by examiner

*Primary Examiner*—Steve R Crow

(57) ABSTRACT

An endless belt for a common exercise treadmill is made of a rubber like material having interwoven a fabric of fine steel mesh or nylon fabric leaving a smooth finish at upper and lower extremity over entire length and width thereof. An array of through holes penetrating said endless belt across the entire width and length thereof is to provide for fastening elements to be capable to affix prefabricated objects the like of simulated cobblestones of various size and configuration to the upper extremity of said endless belt and to be in contiguous fashion with lower extremity of simulated cobble stone.

5 Claims, 3 Drawing Sheets

EXERCISE TREADMILL HAVING A SIMULATED COBBLESTONE RUNNING SURFACE

RELATED APPLICATIONS

This application claims the priority date of prior filed applications having Ser. No. 60/698,502 and filing date of Jul. 11, 2005 and entitled: Exercise treadmill having a simulated cobblestone-running surface.

INCORPORATION BY REFERENCE

Applicant(s) herein incorporate by reference, any and all U.S. patents and U.S. patent applications cited or referred to in this application.

BACKGROUND OF THE INVENTION

1. Field of Invention

This invention relates generally to exercising equipment and more particular to a treadmill for performing walking, jogging and running having an endless running surface with a particular surface condition.

2. Background

Exercising treadmills are very common and readily available in various configurations. They are used for performing aerobics, walking, running and the like with the user remaining in a relative stationary position during the exercise. Other treadmills are used for therapy and diagnostic purposes the like of cardiovascular stress testing. For all these purposes an user of an exercise treadmill normally performs an exercise routine at a relatively steady and continuous level of physical activity.

3. Description of Related Art

The following art defines the present state of this field: Examples of treadmills for exercising purposes are described in U.S. Pat. Nos. 5,279,528, 4,659,074, 4,635,928, 4,635,927, 4,334,676.

Exercising treadmills normally have an endless running surface, which is extended between and movable around a pair of substantially parallel pulleys at each end of the treadmill. A running surface may comprise an endless belt of a rubber like material of given thickness. An endless belt is normally driven by a motorized arrangement having a pulley encircled by an endless chain loop engaging a pinion gear mounted to the axle of a motor shaft engaging relatable with a drive sprocket mounted to the axle shaft of a pulley as such traveling an endless belt in a forward direction. A rubber like material is normally of sturdy and high tensile strength fashion strong enough to withstand continuous pounding and pulling by a user walking or jogging on an endless belt. An endless belt is typically supported along at least its length and width between said pulleys by one of several well-known designs in order to enable an endless belt to support the weight of a user. For example, rollers may be positioned below said endless belt or a web in horizontal plane in contiguous fashion with under side of said endless belt in particular a smooth panel made of wood or metal in order to provide the required support. Depending on the general application said endless belt may be of a homogeneous material or in some other application thereof may be of a top layer laminated to a bottom layer the latter consisting of a rubber like material having interwoven nylon fabric or steel wire mesh for purpose of strengthening and reinforcement. It is known that many similar configurations of said endless belt as aforesaid are common and easily to be obtained and have been proven to be of particular ruggedness and strength as well as suited for all purpose conveyor belts used for industrial applications therefore is of particular suitability for said exercising treadmills having said panel for support and where minimization of friction and wear of said endless belt is of great importance and is consequential to the overall function ability of said exercising treadmill. The running surface of said endless belt is typically of a smooth and non-textured finish exclusively designed to the convenience of said user in a fashion to simulate running surfaces the like of asphalt or professional track and field type terrain. It is known and has been established that simulation of said running surface to a natural occurring terrain the like of non smoothened natural ground, pebbles and cobble stones are considered to be of great benefit to a user resulting in improved balance control, cardiovascular fitness and weight control. It is now known that walking and running on a cobble stone strewn surface the like of certain areas of strand can be of up to 50 percent more beneficial in terms of health benefits to a user than just walking and running on smooth artificial surfaces. Therefore a running surface constructed for a common treadmill to include the like of cobble stone texture may be considered of great benefit to a user.

SUMMARY OF INVENTION

The present invention teaches certain benefits in construction and use, which give rise to the objectives described below.

An endless belt for a common exercise treadmill is made of a rubber like material having interwoven a fabric of fine steel or nylon mesh leaving a smooth finish to upper and lower extremity over entire length and width thereof. An array of through holes penetrating said endless belt across the entire width and length thereof is to provide for fastening elements to be capable to affix prefabricated objects the like of simulated cobblestones of various size and configuration urged upon the upper extremity of said endless belt.

A primary objective of one embodiment of the present invention is to provide an apparatus and method of use of such apparatus that yields advantages not taught by the prior art.

A still further objective is to assure that an embodiment of the invention is to provide a means to closely simulate a cobble stone terrain the like of occurring in natural state.

Another objective is to assure that an embodiment of the invention is capable to be used with common treadmill designs of various size and configuration necessitating only minor modifications thereof.

A still further objective is to assure that an embodiment of the invention is to assure that various size and array of simulated cobblestones can be used with an endless belt.

A still further objective is to assure that an embodiment of the invention is assure the endless belt having simulated cobble stones to be easily adaptable to any given treadmill configuration for retrofit.

A still further objective is to assure that an embodiment of the invention is capable to be used with treadmills having a relatively small pulley in circumference.

A yet still further objective is to assure that an embodiment of the invention is to assure that the endless belt having simulated cobblestones is of a construction thereof not to be deformed and strained when surrounding pulley.

A still further objective is to assure that an embodiment of the invention is conceived to present advantages over other inventions for a treadmill providing cobblestone like running surface with one advantage providing the ability to readily change a preferred configuration to another preferred configuration done and completed by the end user of this invention.

Other features and advantages of the embodiments of the present invention will become apparent from the following more detailed description, taken in conjunction with the accompanying drawings, which illustrate, by the way of example, the principles of at least one of the possible embodiments of the invention.

BRIEF DESCRIPTION OF THE DRAWINGS

The accompanying drawings illustrate at least one of the best mode embodiments of the present invention. In such drawings.

DETAILED DESCRIPTION OF THE INVENTION

The above-described drawing figures illustrate the present invention in at least one of its preferred, best mode embodiments, which are further, defined in detail in the following description. Those having ordinary skill in the art may be able to make alterations and modifications in the present invention without departing from its spirit and scope. Therefore it must be understood that the illustrated embodiments have been set forth only for the purposes of example and that they should not be taken as limiting the invention as defined in the following.

Figure 1:
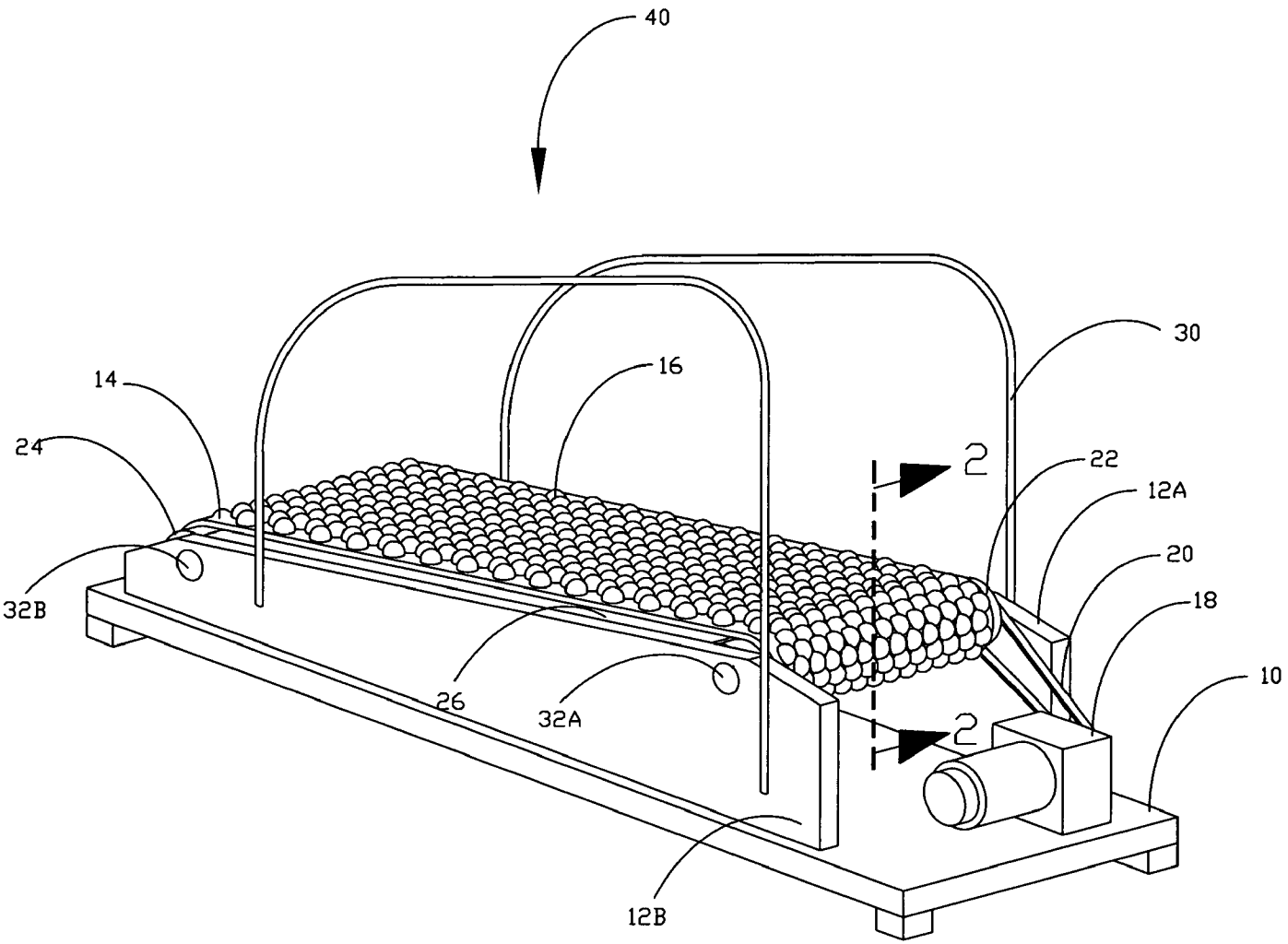
FIG. 1 is a perspective view of a preferred embodiment of present invention showing a common treadmill equipped with an endless belt having simulated cobblestones attached to upper extremity thereof.

FIG. 1 shows an isometric view of embodiment of present invention. Treadmill 40 is having endless belt 14 with attached plurality of simulated cobblestone 16. Base 10 is supporting motorized gear actuator 18 and side bracket 12A and 12B respectively. Between side bracket 12A and 12B is mounted drive pulley 22 and idler pulley 24 respectively and rotationally affixed about center axle 32A and 32B respectively. Support panel 26 is a member of structural integrity as such providing support to underside of endless belt 14 in contiguous fashion thereto. An incline of endless belt 14 as shown may not be of permanent fashion and can be of varying degree of incline depending on preference of user. There are many commonly available treadmills of varying configurations and incline capabilities for endless belt 14 therefore a description as to the apparatus facilitating an adjustable incline thereof has been negated from this specification. Plurality of holding rail 30 is rigidly connected to side bracket 12A and 12B respectively to provide a bracing and holding aid for user.

Figure 2:
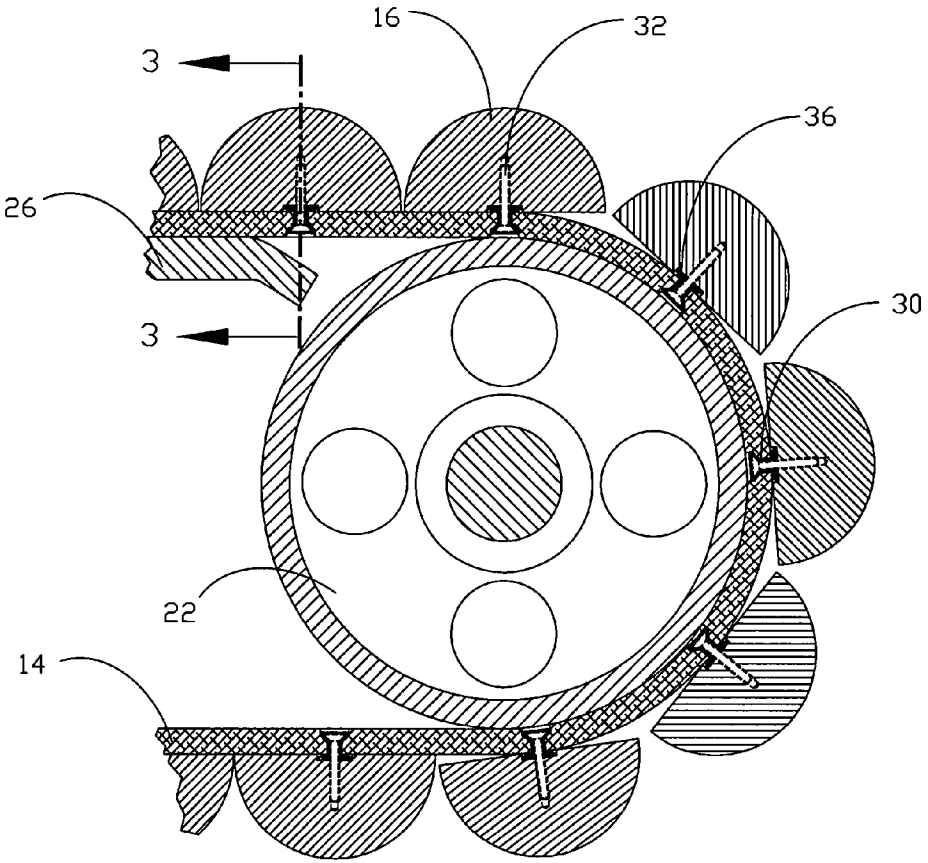
FIG. 2 is a partial crossectional view taken along lines 2-2 respectively in FIG. 1.

FIG. 2 shows a cross sectional and cut away view of an embodiment of present invention. Endless belt 14 partially encircles drive pulley 22 whereas plurality of simulated cobblestone 16 is affixed to upper extremity of endless belt 14 via engagement with fastening element 32. Most notably this highlights the effectiveness of singular and centered location thereof with plurality of simulated cobblestone 16 as such warranting lower extremity of endless belt 14 to be contiguous with outer extremity of pulley 22 and idler 24, not shown, and support panel 26 respectively thus providing proper traction and support of endless belt 14 during use. Additionally aforesaid guarantees non-impairment of natural pliability of end less belt 14 when circumventing drive pulley 22 and idler 24 respectively, not shown. Thus a single point engagement for plurality of simulated cobble stone 16 to upper extremity of endless belt 14 provides adaptability there to with pulley 22 and idler 24 of small circumference as may be found on certain type of common treadmills. Plurality of fastening element 32 is engaged with plurality of eyelet 30 and plurality of lock washer 36 thereof urging against lower extremity of plurality of simulated cobble stone 16 and upper extremity of endless belt 14 respectively.

Figure 3:
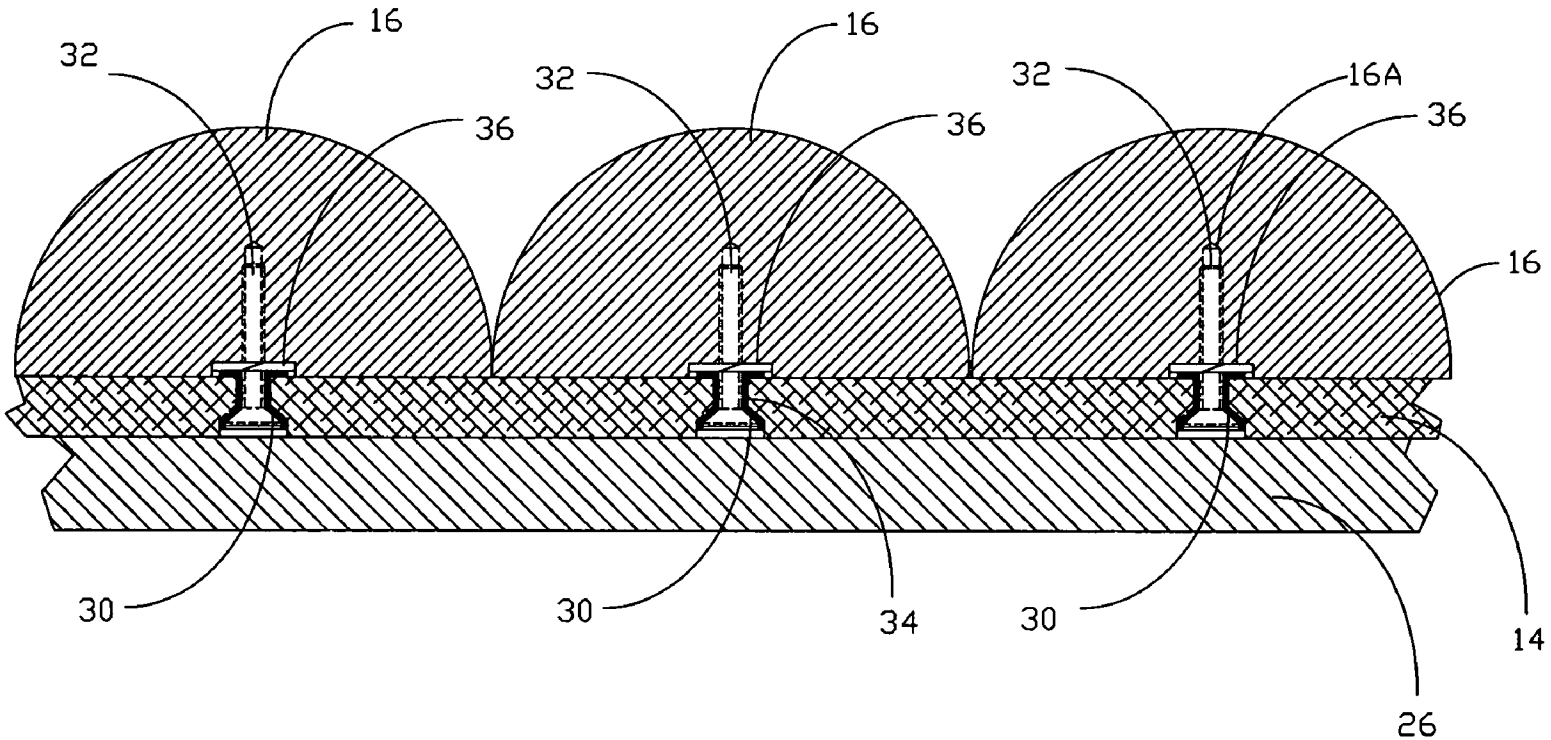
FIG. 3 is a cross sectional view taken along lines 3-3 respectively in FIG. 2.

FIG. 3 shows a cross sectional cut away view of an embodiment of present invention. Endless belt 14 with plurality of simulated cobblestone 16 is engaged to upper extremity thereof. Plurality of eyelet 30 preferably made of metal is engaged with plurality of through hole 34 in endless belt 14 thereof to be contained by urging against counter sink portion of through hole 34 where as opposing end of eyelet 30 is peened and urged against upper extremity of endless belt 14. Therefore plurality of eyelet 30 is permanently contained to endless belt 14. Fastening element 32 is engaged with eyelet 30 and lock washer 36 and threaded hole 16A respectively thereof urging against counter sink portion of eyelet 30 thereby urging lower extremity of simulated cobble stone 16 against upper extremity of endless belt 14. Lower extremity of eyelet 30 and fastening element 32 shows sufficient clearance away from upper extremity of support panel 26 and outer extremity of pulley 22 as such providing non impaired support and traction of endless belt 14 in contiguous fashion thereto.

The enablements described in detail above are considered novel over the prior art of record and are considered critical to the operation of at least one aspect of one best mode embodiment of the instant invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specifications as including more than one meaning, then its use must be understood as being generic to all possible meanings supported by the specifications and by the word or words describing the element.

The definitions of the words or elements of the embodiments of the herein described invention and its related embodiments not described are, therefore, in this specifications to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the invention and its various embodiments or that a single element may be substituted for two or more elements in a claim. Changes from the claimed subject matter as viewed by a person with ordinary skill in the art, not known or later devised, are expressly contemplated as being equivalents within the scope of the invention and its various embodiments. Therefore, obvious substitutions now or later known to one with ordinary skill in the art defined to be within the scope of the defined elements. The invention and its various embodiments are thus to be understood to include what is specifically illustrated and described above, what is conceptually equivalent, what can obviously substituted, and also what essentially incorporates the essential idea of the invention.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. An endless running surface tread for use with a treadmill including a frame with a pair of substantially parallel pulleys at each end of said frame with said endless running surface thread extending between and partially encircling said pair of pulleys, and a support panel situated below the upper portion of said endless running surface thread, comprising:

An endless belt having a sufficient thickness and provided with a plurality of mounting holes there through;

A plurality of eyelets affixed within said mounting holes and each said eyelet configured in dimension not to protrude lower extremity of said endless belt;

A plurality of simulated cobble stones, each said cobble stones having a blind hole centered at the lower extremity thereof and said blind hole having a thread;

A counter bore in coaxial alignment to said blind hole with said counter bore situated at the lower extremity of said simulated cobble stone;

A plurality of fastening elements, each said fastening element including a circular and threaded column ending upwardly from a bottom portion, wherein said bottom portion and circular column is dimensioned for insertion through and mating to a respective said eyelet, and whereby said plurality of simulated cobble stones are being disposed over the said plurality of mounting holes at the upper extremity of said endless belt and secured thereto by a plurality of lock washers in combination with inserting said circular column of said fastening element from said lower extremity of said endless belt through said eyelet and through said lock washer and threading said circular column into said blind hole of said simulated cobble stone; whereby said plurality of cobble stones are arranged on a majority of the endless belt surface.

2. The endless running surface tread of claim 1 further including said plurality of simulated cobble stones wherein the upper portion thereof comprises a rounded and convex configuration whereas the lower extremity comprises a horizontal surface without slope, tilt or curvature respectively.

3. The endless running surface tread of claim 1 further including said plurality of simulated cobble stones wherein said lock washer is disposed into said counter bore.

4. The endless running surface tread of claim 1 further including said plurality of lock washers comprising a split washer providing means for exerting pressure onto said eyelet and said counter bore respectively thereby preventing loosening of said fastening element.

5. The endless running surface tread of claim 4 further including said plurality of mounting holes thereof arranged in a plurality of rows at equal intervals thereby providing means for mounting said simulated cobble stones of various size in circumference.

* * * * *